US008528510B2

(12) United States Patent
Hayman et al.

(10) Patent No.: US 8,528,510 B2
(45) Date of Patent: Sep. 10, 2013

(54) INTAKE MANIFOLD

(75) Inventors: Alan W. Hayman, Romeo, MI (US); Eric C. Douse, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 227 days.

(21) Appl. No.: 13/004,986

(22) Filed: Jan. 12, 2011

(65) Prior Publication Data

US 2011/0174257 A1 Jul. 21, 2011

Related U.S. Application Data

(60) Provisional application No. 61/295,257, filed on Jan. 15, 2010.

(51) Int. Cl.
*F02M 35/10* (2006.01)

(52) U.S. Cl.
USPC ..... 123/184.34; 123/184.25; 123/184.26; 123/184.27; 123/184.31; 123/184.35; 123/184.37; 123/184.38; 123/184.43; 123/184.42; 123/184.44; 123/184.47; 123/184.48; 123/184.49; 123/184.59

(58) Field of Classification Search
USPC ..... 123/184.25, 184.26, 184.27, 184.31, 123/184.35, 184.34, 184.37, 184.38, 184.43, 123/184.42, 184.44, 184.47, 184.48, 184.49, 123/184.59, 54.5
See application file for complete search history.

(56) References Cited

U.S. PATENT DOCUMENTS 3,109,416 A * 11/1963 Hurst et al. ..... 123/58.1
3,791,144 A 2/1974 Lang
4,086,763 A 5/1978 Matsushita et al.
4,177,640 A 12/1979 Kuroda et al.
4,258,547 A 3/1981 Fenn
4,262,639 A 4/1981 Motosugi et al.

(Continued)

FOREIGN PATENT DOCUMENTS

CN 1416502 A 5/2003
DE 60020493 T2 10/2005

(Continued)

OTHER PUBLICATIONS

DE Office Action dated Nov. 5, 2012 for DE Patent Application No. 10 2011 008 609.9; 4 pages.

(Continued)

*Primary Examiner* — Lindsay Low
*Assistant Examiner* — Charles J Brauch
(74) *Attorney, Agent, or Firm* — Cantor Colburn LLP

(57) ABSTRACT

An intake assembly for a 3-cylinder, V-configured engine comprises an intake manifold configured to conduct combustion air to a first, two-cylinder, cylinder head housing assembly and a second, single-cylinder, cylinder head housing assembly. A centrally extending plenum defines a plenum axis. A first plurality of intake runners, in fluid communication with the plenum, extend from a front side and transition through a circumferential arc around an upper side to deliver combustion air to, the first, two-cylinder, cylinder head housing assembly. A single intake runner, in fluid communication with the centrally extending plenum, extends from a rear side and transitions through a circumferential arc around the upper side to deliver combustion air to, the second, single-cylinder, cylinder head housing assembly. A zip tube delivers combustion air to the central plenum at a location that is between one of the first plurality of intake runners and the single cylinder intake runner.

10 Claims, 3 Drawing Sheets

(56) References Cited

U.S. PATENT DOCUMENTS

| | | | | | |
|---|---|---|---|---|---|
| 4,480,600 | A | * | 11/1984 | Gill | 123/54.5 |
| 4,805,403 | A | | 2/1989 | Bowman et al. | |
| 4,889,083 | A | * | 12/1989 | Honma et al. | 123/184.34 |
| 5,003,932 | A | * | 4/1991 | Duncan | 123/184.34 |
| 5,046,578 | A | | 9/1991 | Nakayama et al. | |
| 5,181,491 | A | * | 1/1993 | Izumi et al. | 123/336 |
| 5,339,918 | A | | 8/1994 | Nakayama et al. | |
| 5,492,088 | A | * | 2/1996 | Ohrnberger | 123/184.34 |
| 5,531,291 | A | | 7/1996 | Sato et al. | |
| 5,613,470 | A | | 3/1997 | Shiomi et al. | |
| 5,630,386 | A | * | 5/1997 | Uchida | 123/184.34 |
| 5,660,154 | A | * | 8/1997 | Fields | 123/184.42 |
| 5,901,677 | A | * | 5/1999 | Ohrnberger et al. | 123/184.31 |
| 6,095,105 | A | * | 8/2000 | Lohr et al. | 123/90.38 |
| 6,161,513 | A | * | 12/2000 | Lohr et al. | 123/184.34 |
| 6,357,401 | B1 | | 3/2002 | Moriyama et al. | |
| 6,510,912 | B1 | | 1/2003 | Atsuumi | |
| 6,745,730 | B2 | | 6/2004 | Yamashita | |
| 6,941,914 | B2 | | 9/2005 | Snyder et al. | |
| 7,070,526 | B2 | | 7/2006 | Lawrence | |
| 7,131,416 | B2 | * | 11/2006 | Sasaki et al. | 123/184.36 |
| 7,770,555 | B2 | | 8/2010 | Matsuda | |
| 7,827,955 | B2 | | 11/2010 | Matsuda et al. | |
| 2003/0019464 | A1 | * | 1/2003 | Morii et al. | 123/198 R |
| 2004/0206567 | A1 | | 10/2004 | Kato et al. | |
| 2005/0006168 | A1 | | 1/2005 | Iwasaka et al. | |
| 2005/0257765 | A1 | | 11/2005 | Saitoh et al. | |
| 2006/0144354 | A1 | | 7/2006 | Tanaka et al. | |
| 2006/0283418 | A1 | | 12/2006 | Matsuda et al. | |
| 2008/0210189 | A1 | * | 9/2008 | Boyes et al. | 123/184.56 |
| 2011/0209937 | A1 | | 9/2011 | Belzile et al. | |

FOREIGN PATENT DOCUMENTS

| | | | |
|---|---|---|---|
| DE | 102008020423 | A1 | 10/2009 |
| JP | 2000274321 | A | 10/2000 |
| WO | 2009096977 | A1 | 8/2009 |

OTHER PUBLICATIONS

Chinese Office Action for Application No. 201110052804.2 dated Apr. 9, 2013; 8 pages.

* cited by examiner

INTAKE MANIFOLD

CROSS-REFERENCES TO RELATED APPLICATIONS

This patent application claims priority to U.S. Provisional Patent Application Ser. No. 61/295,257 filed Jan. 15, 2010 which is hereby incorporated herein by reference in its entirety.

FIELD OF THE INVENTION

Exemplary embodiments of the present invention relate to a V-configured 3-cylinder engine and, more particularly, to a low profile, compact intake manifold therefore.

BACKGROUND

Environmental sustainability, increasing global energy demands and the resulting rise in fuel cost and relatively new demand in developing economies for independent but less costly transportation is driving vehicle and powertrain designers towards smaller and more fuel efficient vehicles. It is not uncommon to find inline 3 and 4 cylinder engines powering many medium to small sized vehicles. However, these engines are length constrained by their inline cylinder configurations which operate to define the minimum vehicle architectural space in which they may be packaged. Narrow angle V-configured engines offer some additional packaging advantages by staggering pistons in offset banks, offering additional pistons and resulting power, without unnecessarily increasing the length of the engine package. However, engine height may suffer in such engines due to the use of a single cylinder head having a height beyond that required for an inline engine.

SUMMARY OF THE INVENTION

In an exemplary embodiment, an internal combustion engine comprising an engine block having a lower end closed by an oil pan and an upper end extending at an angle $\alpha$ from a rear of the engine block to a front thereof, a first, two-cylinder, cylinder head housing assembly reclined from vertical, towards the rear of the engine block, about an axis of the crankshaft by an angle $\beta$, a second, single-cylinder, cylinder head housing assembly oriented an angle $\gamma$, about an axis of the crankshaft, from the first, two-cylinder, cylinder head housing assembly has a low profile intake assembly configured to conduct combustion air to the first, two-cylinder, cylinder head housing assembly and the second, single-cylinder, cylinder head housing assembly. The low profile intake assembly comprises an intake manifold, a centrally extending plenum that extends axially in parallel to the crankshaft axis and defines a plenum axis, a first plurality of intake runners, in fluid communication with the centrally extending plenum, extend from the front side of the plenum and transition through a circumferential arc around the upper side thereof to fluidly couple with, and deliver combustion air to, the first, two-cylinder, cylinder head housing assembly, a single intake runner, in fluid communication with the centrally extending plenum, extends from the rear side of the plenum and transitions through a circumferential arc around the upper side thereof to fluidly couple with, and deliver combustion air to, the second, single-cylinder, cylinder head housing assembly and a zip tube configured to deliver combustion air to the central plenum at a location that is between one of the first plurality of intake runners and the single cylinder intake runner, wherein the zip tube approaches the central plenum from the front side and transitions through a circumferential arc around the upper side thereof to fluidly couple with, and deliver the combustion air to the central plenum.

In another exemplary embodiment, a low profile intake assembly for a 3-cylinder, V-configured engine comprises an intake manifold configured to conduct combustion air to a first, two-cylinder, cylinder head housing assembly and a second, single-cylinder, cylinder head housing assembly comprises a centrally extending plenum that extends axially in parallel to a crankshaft axis of the 3-cylinder, V-configured engine and defines a plenum axis, a first plurality of intake runners, in fluid communication with the centrally extending plenum, extend from the front side of the plenum and transition through a circumferential arc around the upper side thereof to fluidly couple with, and deliver combustion air to, the first, two-cylinder, cylinder head housing assembly, a single intake runner, in fluid communication with the centrally extending plenum, extends from the rear side of the plenum and transitions through a circumferential arc around the upper side thereof to fluidly couple with, and deliver combustion air to, the second, single-cylinder, cylinder head housing assembly and a zip tube, configured to deliver combustion air to the central plenum at a location that is between one of the first plurality of intake runners and the single cylinder intake runner, wherein the zip tube approaches the central plenum from the front side and transitions through a circumferential arc around the upper side thereof to fluidly couple with, and deliver the combustion air to the central plenum.

The above features and advantages, and other features and advantages of the invention are readily apparent from the following detailed description of the invention when taken in connection with the accompanying drawings.

DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
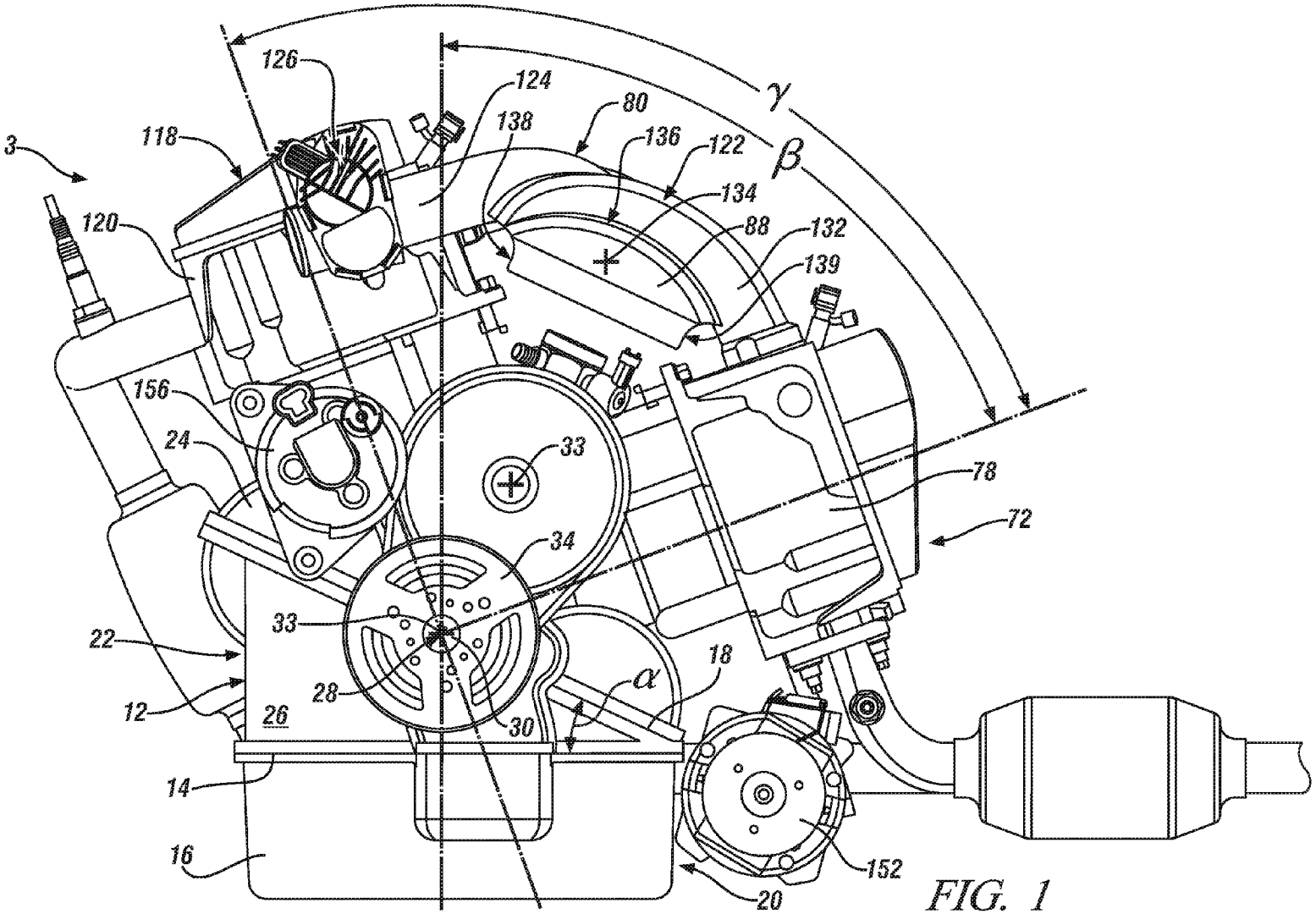
FIG. 1 is side view of a V-configured 3-cylinder engine embodying features of the invention.

The following description is merely exemplary in nature and is not intended to limit the present disclosure, its application or uses. It should be understood that throughout the drawings, corresponding reference numerals indicate like or corresponding parts and features.

Referring to FIG. 1, in an exemplary embodiment there is shown a V-configured 3-cylinder engine 3. The engine 3 includes an engine block assembly 12 having an open lower portion or rim 14 that is closed by an oil reservoir or pan 16. The upper end 18 of the engine block assembly 12 extends at an angle "$\alpha$" from the rear 20 of the engine 3 to the front 22 of the engine and is closed by an engine block cover 24. In an exemplary embodiment it is contemplated that the angle $\alpha$ may vary in a range from about 0° to about 45° depending upon the particular vehicle configuration and other application driven variables of the engine 3. The combination of the engine block assembly 12, the oil pan 16 and the engine block cover 24 defines a crankcase 26 that houses and supports a crankshaft 28, and one or more balance shafts (not shown), for rotation therein. The crankshaft 28 is coupled by a belt, chain or gear drive to rotatably operate a camshaft defining a camshaft axis 33. The camshaft acts upon pushrods (not shown) that extend into cylinder heads 78 and 120 for operation of valve gear (not shown) disposed therein.

In an exemplary embodiment, the crankshaft 28 comprises a crank snout 30 at a first end. The crank snout 30 extends outwardly of the front of the engine block assembly 12 and supports a crankshaft pulley 34 thereon. The crankshaft pulley 34 may be connected via an accessory drive belt (not shown) to various engine driven accessories such as an alternator 152, an air conditioner compressor (not shown), an air pump 156 or a combination thereof.

In an exemplary embodiment two engine cylinders (not shown) are disposed within a first, two-cylinder, cylinder head housing assembly 72 for reciprocation therein. Additionally, a third engine cylinder (not shown) is disposed within a second, single-cylinder, cylinder head housing assembly 118 for reciprocation therein. Closing the upper end of the first, two-cylinder, cylinder head housing assembly 72 is a first cylinder head 78 and closing the upper end of the second, single-cylinder, cylinder head housing assembly 118 is a cylinder head 120.

In an exemplary embodiment, the angling of the upper end 18 of engine block assembly 12 facilitates the angling or reclining from vertical (towards the rear of the engine block) of the first, two-cylinder, cylinder head housing assembly 72 about an axis of the crankshaft by an angle β, for the purposes of packaging the engine 3 in an efficient, low profile manner in a vehicle. In the embodiment illustrated in FIG. 1, the rearward bank angle β of the first, two-cylinder, cylinder head housing assembly 72 is about 70° from vertical. It is contemplated, however, that the rearward bank angle β may vary from about 30° to about 90° depending upon the particular vehicle configuration and other application driven variables. The third engine cylinder and second, single-cylinder, cylinder head housing assembly 118 may be oriented at an angle "γ" that is about 90 degrees from the two inline cylinders of the first, two-cylinder, cylinder head housing assembly 72 respectively. It is contemplated, however, that the angle "γ" may vary from about 25° to about 115°; again depending upon the particular vehicle configuration and other application driven variables. Such an orientation, as is illustrated in FIG. 1, will allow the V-configured 3-cylinder engine 3 to maintain a low profile while providing extra power that may be required for certain applications and is not available in a 2-cylinder, inline configuration. The single, relatively upright oriented second, single-cylinder, cylinder head housing assembly 118 is small enough and centrally located so as to result in the same vehicle packaging and interior space benefits that may be realized with an inline 2-cylinder engine.

Figure 2:
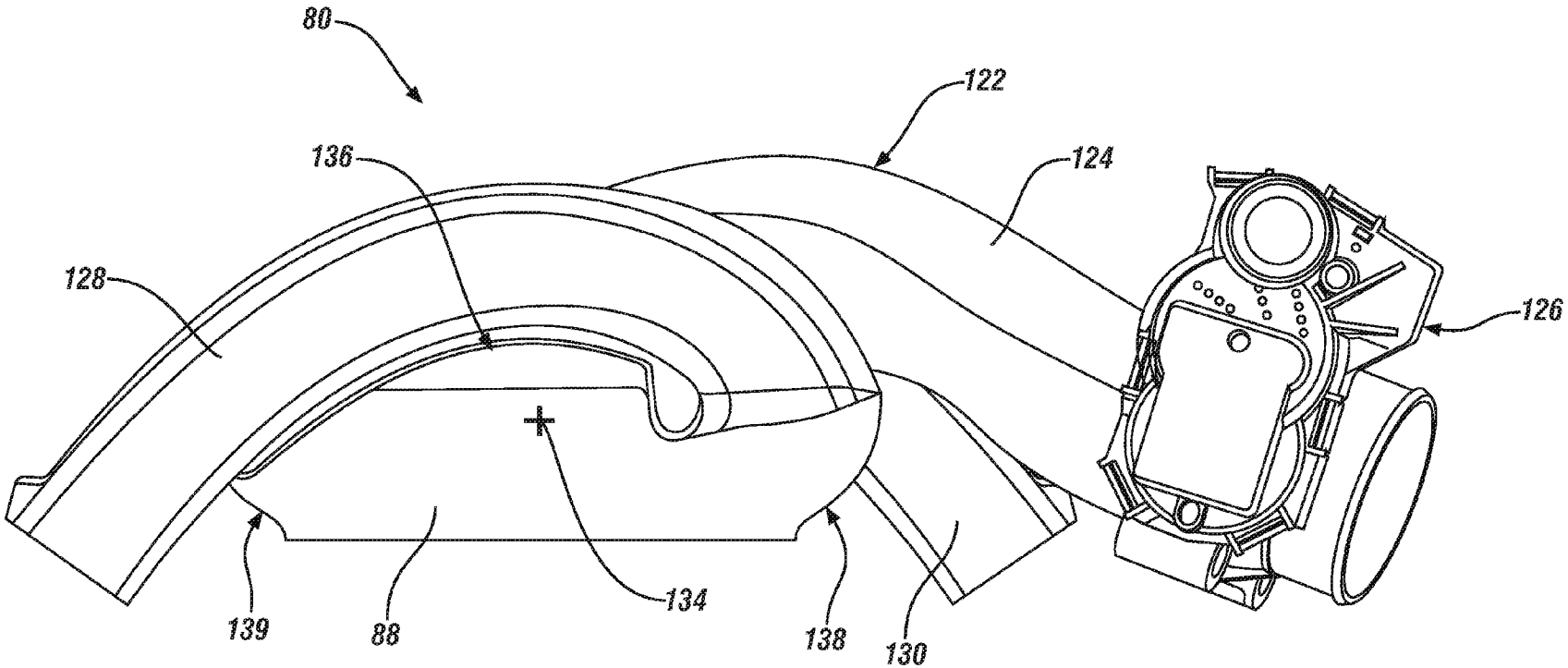
FIG. 2 is an end or side view of an intake manifold embodying features of the invention.
Figure 3:
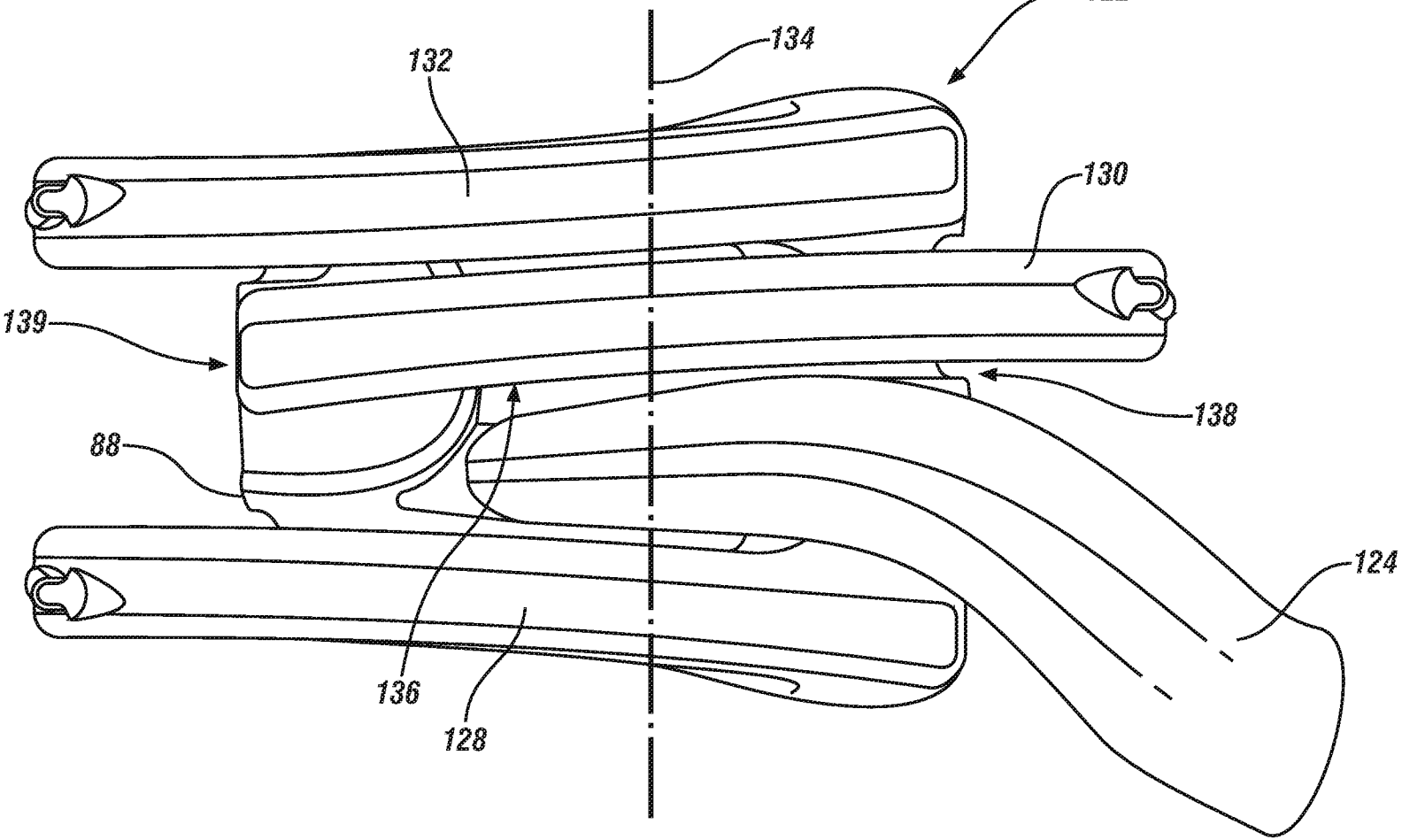
FIG. 3 is a top or plan view of the intake manifold of FIG. 2.

A low profile intake assembly 80 is configured to conduct combustion air to the cylinder heads 78, 120. Referring to FIGS. 1-3, the intake assembly 80 comprises an intake manifold 122 having an inlet runner or "zip tube" 124 for receiving metered combustion air through a throttle body 126. The inlet runner 124 fluidly connects with and delivers combustion air to a centrally extending plenum 88 of the intake manifold 80. The centrally extending plenum 88 extends axially in parallel to the crankshaft axis 31 and defines a plenum axis 134. A plurality of intake runners 128, 130 and 132 are in fluid communication with the centrally extending plenum 88 and conduct combustion air to the cylinder heads 78 and 120. More specifically, the intake runners 128 and 132 extend from the front side 138 of the plenum 88 and transition through a circumferential arc around the upper side 136 thereof to fluidly couple with and deliver combustion air to the two cylinders (not shown) of the first cylinder head 78 of the first, two-cylinder, cylinder head housing assembly 72, FIG. 1. Alternatively, the intake runner 130 extends from the rear side 139 of the plenum 88 and transitions through a circumferential arc around the upper side 136 thereof to fluidly couple with and deliver combustion air to the single cylinder (not shown) of the second cylinder head 120 of the second, single-cylinder, cylinder head housing assembly 118 providing a low profile, crossover configured intake manifold 122 with well balanced combustion airflow in a compact package.

Due to the unique configuration of the 3 cylinder V-configured engine 3, the inlet runner or "zip tube" 124 delivers air to the central plenum 88 at a location that is between one of the 2-cylinder intake runners 128, 132 and the single cylinder intake runner 130. In the exemplary embodiment of FIG. 1 the inlet runner or "zip tube" 124 delivers air to the central plenum 88 at a location that is between the 2-cylinder intake runner 132 and the single cylinder intake runner 130 and in the exemplary embodiment of FIGS. 2 and 3 the inlet runner or "zip tube" 124 delivers air to the central plenum 88 at a location that is between the intake runner 128 and the single cylinder intake runner 130. The difference is defined solely by application and packaging constraints of the engine 3. The inlet runner or "zip tube" 124 approaches the central plenum 88 from the front side 138 and transitions through a circumferential arc around the upper side 136 thereof to fluidly couple with and deliver combustion air to the central plenum; again providing a low profile, crossover configured intake manifold 122 with well balanced combustion airflow in a compact package. Referring again to FIG. 1, the intake manifold 122 assembles easily in the space between the first and second cylinder head housing assemblies 72 and 118 without extending above or adding to the height of the second, single cylinder head 120.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the present application.

What is claimed is:

1. An internal combustion engine comprising:

an engine block assembly having a lower end closed by an oil pan and an upper end extending at an angle α from a rear of the engine block assembly to a front thereof;

a first, two-cylinder, cylinder head housing assembly reclined from vertical, towards the rear of the engine block, about an axis of the crankshaft by an angle β;

a second, single-cylinder, cylinder head housing assembly oriented at an angle γ, about an axis of the crankshaft, from the first, two-cylinder, cylinder head housing assembly;

a low profile intake assembly including an intake manifold configured to conduct combustion air to the first, two-cylinder, cylinder head housing assembly and the second, single-cylinder, cylinder head housing assembly comprising:

a centrally extending plenum that extends axially in parallel to the crankshaft axis and defines a plenum axis;

a first plurality of intake runners, in fluid communication with the centrally extending plenum, extend from a front side of the plenum and transition through a circumferential arc around an upper side thereof to fluidly couple with, and deliver combustion air to, the first, two-cylinder, cylinder head housing assembly;

a single intake runner, in fluid communication with the centrally extending plenum, extends from a rear side of the plenum and transitions through a circumferential arc around the upper side thereof to fluidly couple with, and deliver combustion air to, the second, single-cylinder, cylinder head housing assembly; and a zip tube configured to deliver combustion air to the central plenum at a location that is between one of the first plurality of intake runners and the single cylinder intake runner, wherein the zip tube approaches the central plenum from the front side and transitions through a circumferential arc around the upper side thereof to fluidly couple with, and deliver the combustion air to the central plenum.

2. The internal combustion engine of claim 1, wherein the angle $\alpha$ is within the range of about 0 degrees to about 45 degrees.

3. The internal combustion engine of claim 2, wherein the angle $\alpha$ is within the range of about 45 degrees.

4. The internal combustion engine of claim 1, wherein the angle $\beta$ is within the range of about 30 degrees to about 90 degrees.

5. The internal combustion engine of claim 4, wherein the angle $\beta$ is within the range of about 70 degrees.

6. The internal combustion engine of claim 1, wherein the angle $\gamma$ is within the range of about 25 degrees to about 115 degrees.

7. The internal combustion engine of claim 6, wherein the angle $\gamma$ is within the range of about 90 degrees.

8. The internal combustion engine of claim 1, wherein low profile intake assembly assembles in the space between the first, two-cylinder, cylinder head housing assembly and the second, single-cylinder, cylinder head housing assembly without extending above or adding to the height of the second, single-cylinder, cylinder head housing assembly.

9. A low profile intake assembly for a 3-cylinder, V-configured engine comprising:

an intake manifold configured to conduct combustion air to a first, two-cylinder, cylinder head housing assembly and a second, single-cylinder, cylinder head housing assembly comprising:

a centrally extending plenum that extends axially in parallel to a crankshaft axis of the 3-cylinder, V-configured engine and defines a plenum axis;

a first plurality of intake runners, in fluid communication with the centrally extending plenum, extend from a front side of the plenum and transition through a circumferential arc around an upper side thereof to fluidly couple with, and deliver combustion air to, the first, two-cylinder, cylinder head housing assembly;

a single intake runner, in fluid communication with the centrally extending plenum, extends from a rear side of the plenum and transitions through a circumferential arc around the upper side thereof to fluidly couple with, and deliver combustion air to, the second, single-cylinder, cylinder head housing assembly; and a zip tube, configured to deliver combustion air to the central plenum at a location that is between one of the first plurality of intake runners and the single cylinder intake runner, wherein the zip tube approaches the central plenum from the front side and transitions through a circumferential arc around the upper side thereof to fluidly couple with, and deliver the combustion air to the central plenum.

10. The low profile intake assembly of claim 9, wherein the intake manifold assembles in a space between a first, two-cylinder, cylinder head housing assembly and a second, single-cylinder, cylinder head housing assembly without extending above, or adding to, the height of the second, single-cylinder, cylinder head housing assembly.

* * * * *